US011812828B2

(12) United States Patent
Loetscher

(10) Patent No.: US 11,812,828 B2
(45) Date of Patent: Nov. 14, 2023

(54) ADJUSTABLE WRISTLET CLASP

(71) Applicant: OMEGA SA, Bienne (CH)

(72) Inventor: Philippe Loetscher, Evilard (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 17/829,839

(22) Filed: Jun. 1, 2022

(65) Prior Publication Data

US 2023/0108801 A1 Apr. 6, 2023

(30) Foreign Application Priority Data

Oct. 1, 2021 (EP) ..... 212005440

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/24; Y10T 24/2155; Y10T 24/4782
See application file for complete search history.

(56) References Cited

U.S. PATENT DOCUMENTS 2,455,302 A * 11/1948 Gotti ..... A44C 5/246 24/71 J
2,677,147 A * 5/1954 Phillips ..... E05D 7/105 16/266
3,233,277 A * 2/1966 Hirashiki ..... E05D 1/04 D25/160
3,521,331 A 7/1970 Gay
3,685,106 A * 8/1972 Gandelman ..... A44C 5/2033 63/5.1
4,546,522 A * 10/1985 Gygax ..... A44C 5/24 24/70 J
5,771,543 A * 6/1998 Froidevaux ..... A44C 5/246 24/69 J (Continued)

FOREIGN PATENT DOCUMENTS

JP 43-8388 Y1 4/1968
JP 2019-30636 A 2/2019

OTHER PUBLICATIONS

European Search Report 21 20 0544 dated Mar. 16, 2022.
Japanese Office Action dated May 9, 2023 in Japanese Application No. 2022-082781.

*Primary Examiner* — Robert Sandy
*Assistant Examiner* — Rowland Do
(74) *Attorney, Agent, or Firm* — Sughrue Mion, PLLC

(57) ABSTRACT

A wristlet clasp (100), of the folding buckle type, including first and second blades (1, 2) hinged relative to each other, the first blade (1) further including locking means for holding the first and second blades (1, 2) in their closed position at its second end, and the second blade (2) carrying a member for fastening a first wristlet strand at its second end. The first and second blades are hinged together by movable blades (3, 4) by a first of their respective ends, the hinged blades being connected to the first and second blades via a first hinge (A1) and a second hinge (A2), the hinge (A1, A2) being angularly delimited by stops respectively formed on the first end of the first and second blades and on the second end of the movable blades so as to define two predefined wearing positions depending on the size of the wrist.

9 Claims, 3 Drawing Sheets

(56) References Cited

U.S. PATENT DOCUMENTS

| | | | | |
|---|---|---|---|---|
| 6,119,315 | A * | 9/2000 | Gay | A44C 5/24 24/71 J |
| 9,314,073 | B2 * | 4/2016 | Kaltenrieder | A44C 5/246 |
| 9,993,051 | B2 * | 6/2018 | Kaltenrieder | A44C 5/24 |
| 2007/0028586 | A1 * | 2/2007 | Grossiord | A44C 5/243 59/15 |
| 2009/0241597 | A1 * | 10/2009 | Robert | A44C 5/246 63/3.2 |
| 2014/0150495 | A1 * | 6/2014 | Kaltenrieder | A44C 5/246 63/3.2 |
| 2018/0368540 | A1 * | 12/2018 | Cusin | A44C 5/2042 |
| 2020/0187605 | A1 * | 6/2020 | Catanese | A44C 5/246 |

* cited by examiner

ADJUSTABLE WRISTLET CLASP

CROSS-REFERENCE TO RELATED APPLICATION

This application claims priority to European Patent Application No. 21200544.1 filed Oct. 1, 2021, the entire contents of which are incorporated herein by reference.

TECHNICAL FIELD

The present invention relates to an adjustable clasp for a watch.

The present invention also relates to a wristwatch provided with such a clasp.

PRIOR ART

The problem relating to the need to provide a device for adjusting the length of a wristlet is well known.

It is known to use a clasp which remains attached to the ends of the two wristlet strands. Such a clasp occupies two positions: a closed position, provided for wearing the watch, wherein the strap and the clasp extend around the circumference of the wrist, having a total length allowing the watch to be held, and an open or deployed position which increases the length of the clasp and therefore of the wristlet to allow passage of the hand and removal of the watch.

In a solution with clasp, a first objective is the search for optimal comfort when wearing the wristlet. For this purpose, it is advantageous for the clasp to best match the contour of a wrist, of a large as well as a small wrist, when the clasp is in the closed configuration. A difficulty in the production of a clasp therefore consists in proposing a clasp matching in an adequate and comfortable manner the wrist of a wearer of a wristwatch regardless of the dimensions of the wrist of the wearer.

By way of example, patent application EP 09131060 A1 describes a clasp of the folding buckle type including a cover having a series of pairs of holes intended to house the ends of a strip for fastening a wristlet. Two pairs of adjacent holes are spaced apart by a distance defining an adjustment pitch of the useful length of the wristlet, to address the problems mentioned above.

However, such a device for adjusting the length of the wristlet is unattractive given that the adjustment holes are visible on the sides of the cover. Furthermore, the adjustment operation of such a clasp requires a certain dexterity because it requires introducing a pointed tool into the holes to compress the wristlet fastening strip, which risks leading to damage at the cover in case of clumsiness of the person making the adjustment.

To avoid such a situation, alternative devices have already been disclosed, such as for example in patent EP 0350785 B1 which describes a clasp similar to the previous one but comprising as an alternative a device for adjusting the useful length of the wristlet which can be handled without tools. Indeed, the clasp described in this patent is of the folding buckle type including two blades hinged together by means of a rod passing through both of them, each of the blades carrying at its free end a member for fastening to a wristlet. A first blade carries a hook intended to engage into a hole provided in the second blade to cooperate with a trigger allowing to lock the hook and therefore the clasp in a closed state. The second blade comprises two parts capable of sliding relative to each other within a certain predefined range, defining a pitch for adjusting the useful length of the wristlet. A first of its two parts carries the hinge connecting it to the first blade while the second part carries the locking trigger. The hole wherein the hook engages to lock the clasp has a length, in the longitudinal direction of the wristlet, corresponding to the sliding range between the two parts of the second blade. The trigger has a central part defining two locations for the hook, along the longitudinal direction of the wristlet, corresponding to two different useful lengths of the wristlet. A control member comprising in particular a push-piece allows to actuate the trigger to release the hook and open the clasp.

Such solutions, however, have the disadvantages of making the construction more complex, of increasing its size and of making it difficult to handle the clasp.

DISCLOSURE OF INVENTION

A main object of the present invention is to overcome the disadvantages of clasps known from the prior art, by proposing a wristlet clasp allowing to offer good wearing comfort regardless of the size of the wrist. The invention also aims at providing a wristlet with a simple structure and easy handling.

To this end, the present invention relates more particularly to a wristlet clasp, of the folding buckle type, comprising first and second blades hinged relative to each other, by a first of their respective ends, between a closed position, called wearing position, and at least one open position, said first blade carrying a member for fastening a first wristlet strand at its second end and locking means for holding said first and second blades in their closed position at its second end, and said second blade carrying a member for fastening a second wristlet strand at its second end.

According to the invention, said first and second blades are hinged together by means of a pair of movable blades by a first of their respective ends, said hinged blades being connected to the first and second blades via a first hinge and a second hinge, said hinge being angularly delimited by stops respectively formed on the first end of the first and second blades and on the second end of the mobiles so as to define two predefined wearing positions.

In accordance with other advantageous variants of the invention:

- the amplitude of the angular displacement of the hinges is comprised between 5° and 35°;
- the movable blades have the same length;
- the first ends of the blades and the second ends of the blades have a notch, said ends being arranged to cooperate by interlocking at the notches;
- the free ends of the notches of the blades have a semi-circular shape, and the bottom of the notch has a flat surface;
- the free ends of the notches of the movable blades have a rectilinear shape with a chamfer, and the bottom of the notch has a semi-circular surface;
- the notches of the blades are internal and the notches of the movable blades are external;
- the blades are made of metal, metal alloy, of composite material or of ceramic.

The invention also relates to a wristwatch including a wristlet provided with a clasp in accordance with the invention.

BRIEF DESCRIPTION OF THE DRAWINGS

Other features and advantages of the present invention will appear more clearly upon reading the detailed description of a preferred embodiment which follows, made with reference to the appended drawings given by way of non-limiting examples and wherein.

EMBODIMENT(S) OF THE INVENTION

Figure 1:
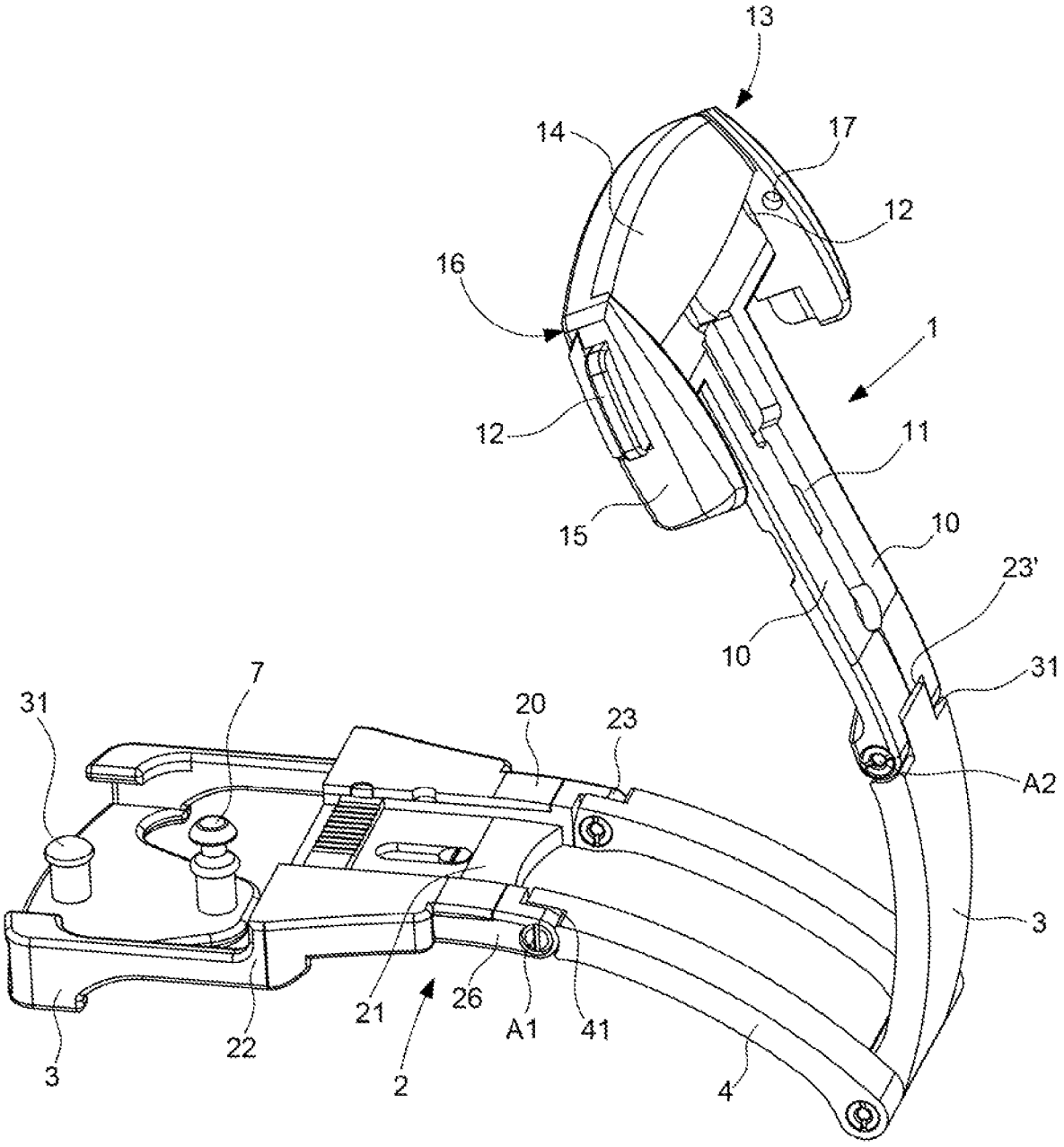
FIG. 1 shows a general perspective view of a wristlet clasp according to the invention, illustrated in the open position.

The clasp illustrated without limitation in the figures corresponds to a preferred embodiment of the present invention. More specifically, the clasp is of the folding buckle type and is intended to close a timepiece wristlet.

As shown in the figures, the clasp 100 includes a first blade 1 hinged on a second blade 2. Each of the blades 1, 2 has an elongated shape in the longitudinal direction of the wristlet and slightly curved to better match the shape of the wrist of a wearer.

The first blade 1 comprises two uprights 10 arranged in contact with each other at one of their ends, each having a cutout 11 such that they are not in contact with each other over the greater part of their length.

Each of the uprights 10 carries an extension 12, close to the other end, extending in a direction perpendicular to the longitudinal direction of the wristlet, to form a push-piece defining a control member allowing to unlock the clasp, as emerges from FIG. 1.

The first blade 1 also comprises a cover 13 having an upper wall 14 bearing side walls 15, and a lower wall 16. The side walls 15 are provided with two orifices 17 allowing one end of a strip for fastening a first wristlet strand, in a conventional manner. The side walls 15 also comprise two recesses allowing the extensions 12 to project, and thus allowing the clasp 1 to be unlocked.

The second blade 2 comprises two arms 20 connected by a transverse upright 21 in their central region. The arms 20 are extended by bent portions 22 defining a loop 3 for a second wristlet strand. The loop 3 has a first pin 7 and a second pin 31, both intended to be engaged in a different hole in the wristlet to define a first and a second anchor point for the wristlet strand to the clasp and thus keep it well aligned relative to the clasp.

Moreover, the free end of the second blade 2 can carry a device for adjusting the useful length of the wristlet intended to be associated with the clasp 100.

As can be seen in FIG. 1, the first and second blades 1, 2 are hinged together by means of a pair of movable blades 3, 4 by a first of their respective ends, the movable blades 3, 4 being connected to the first and second blades 1, 2 via a first hinge A1 and a second hinge A2.

Advantageously, the hinges A1, A2 are angularly delimited by stops respectively formed on the first end of the first and second blades 1, 2 and on the second end of the mobiles 3, 4 so as to define two predefined wearing positions, namely a wearing position for small wrists and a wearing position for large wrists.

Each of the hinges A1 and A2 is angularly delimited by stops 10*a*, 10*b*, 21*a*, 21*b* of the first and second blades 1, 2, cooperating with corresponding stops 30*a*, 30*b*, 40*a*, 40*b* of the movable blades 3, 4. These stops define the first and second positions of the movable blades 3, 4, and implicitly of the clasp, wherein the two blades both occupy the same position.

The movable blades 3, 4 can thus occupy a first position adapted for small wrists and a second position adapted for large wrists, when the clasp is closed. Switching from one position to another occurs naturally when the watch is worn thanks to the stops.

In order to be able to provide a clasp adapted to a large number of wrist morphologies, the amplitude of the angular displacement of the hinges A1, A2 is comprised, for example, between 5° and 35°. Such an amplitude of displacement allows to optimise comfort for the wearer according to the size of his wrist, too little or too much displacement would be detrimental to comfort.

Figure 2:
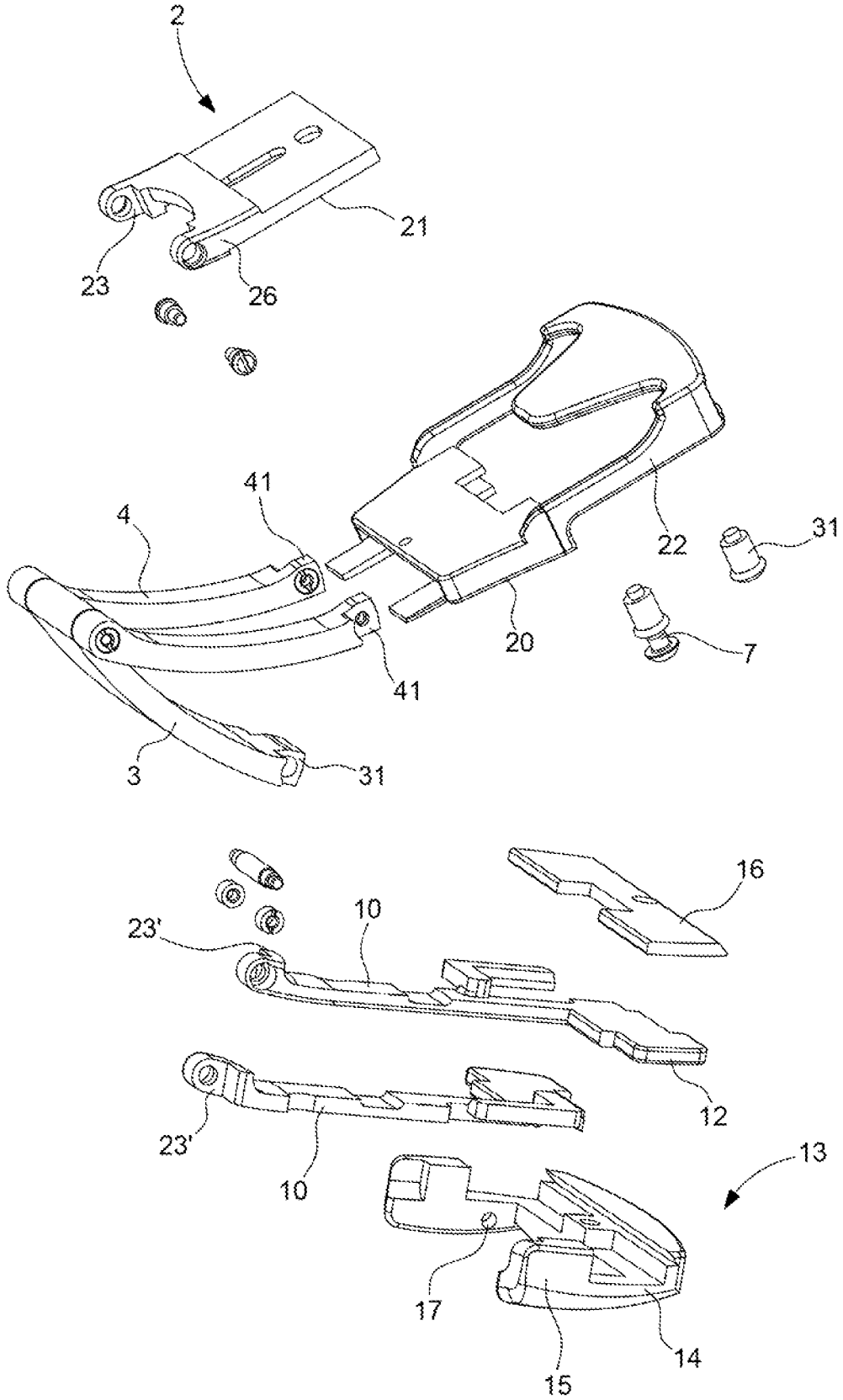
FIG. 2 shows a partially exploded perspective view of the clasp of FIG. 1.
Figure 3:
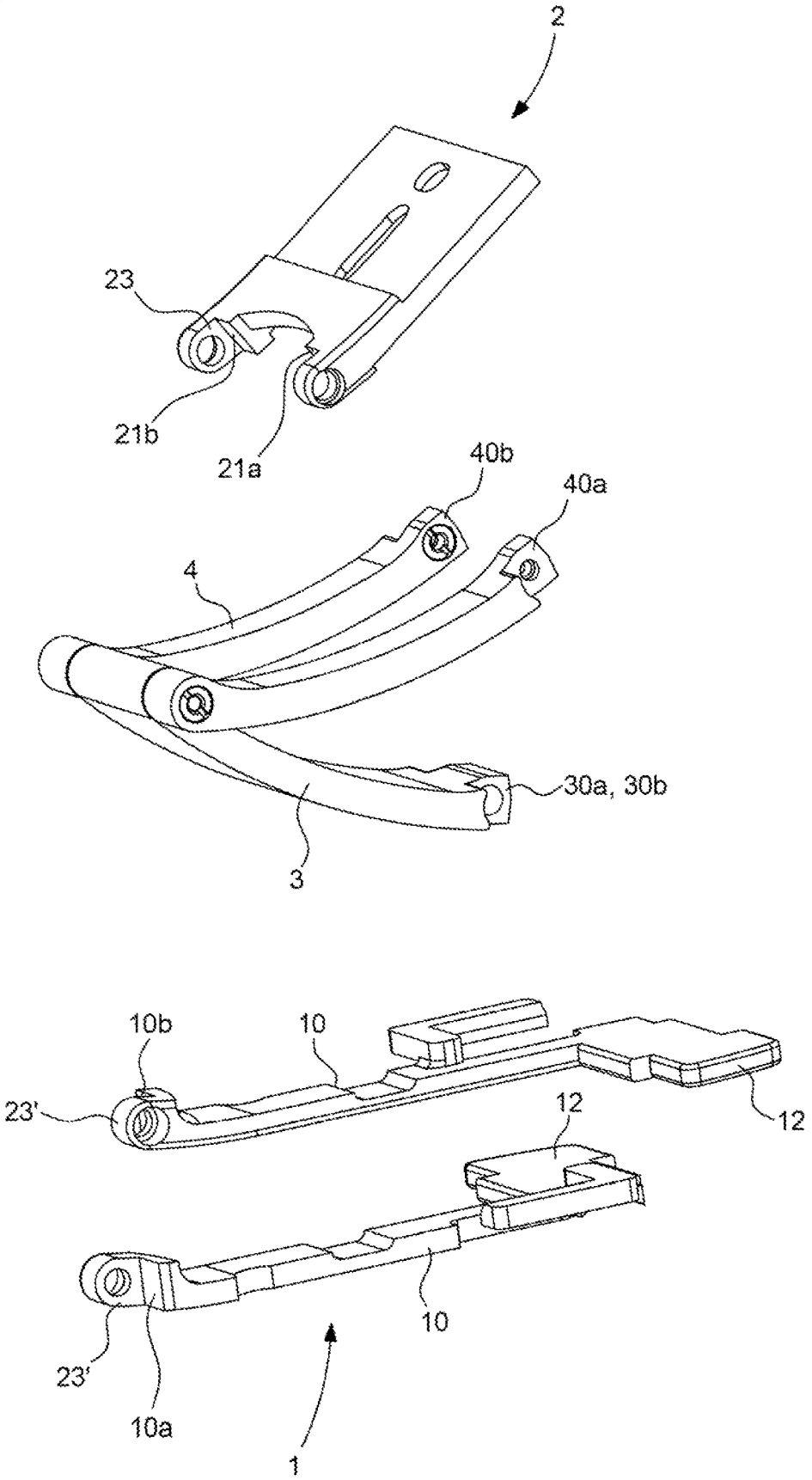
FIG. 3 shows a detailed perspective view of means for adjusting the curvature of the wristlet.

As can be seen in FIGS. 2 and 3, the first ends of the blades 1, 2 and the second ends of the blades 3, 4 each have a notch 23, 23', 31, 41 so as to cooperate by interlocking at these notches. The notches 23, 23' of the first and second blades 1, 2 are internal and the notches 31, 41 of the movable blades 3, 4 are external.

The free ends of the notches 23, 23' of the blades 1, 2 have a semi-circular shape, and the bottom of the notch 23, 23' has a flat surface. The free ends of the notches 31, 41 of the movable blades 3, 4, forming the stops 30*a*, 30*b*, 40*a*, 40*b*, have a rectilinear shape with a chamfer 40*c*, and the bottom of the notch has a semi-circular surface.

Thus, the cooperation between the bottom of the notches 23, 23' and the free end of the notches 31, 41 form the stops, and the chamfer defines the amplitude of the angular displacement of the hinges A1, A2.

It emerges from this description that the clasp according to the present invention comprises a second pair of blades 3, 4 capable of being moved to adjust the curvature of the clasp and of the wristlet. The construction and handling of this clasp are simple and allow the user to easily adjust the clasp when necessary.

The foregoing description sets out to describe a particular embodiment by way of non-limiting illustration and the invention is not limited to the implementation of certain particular features which have just been described, such as for example the shapes specifically illustrated and described for the blades or else their mode of cooperation allowing to ensure the locking of the clasp.

The person skilled in the art will not encounter any particular difficulty in adapting the content of the present disclosure to their own needs and implementing a clasp, in particular for a timepiece, without departing from the scope of the present invention. It will be noted, for example, that the adaptation of the present teaching for the construction of a folding buckle with a structure different from that illustrated and described will not pose any particular difficulty for the person skilled in the art.

The invention claimed is:

1. A wristlet clasp, of the folding buckle type, comprising:

first and second blades hinged relative to each other, at a first of their respective ends, said first and second blades hinging between a closed position, called wearing position, and at least one open position, said first blade being configured to fasten to a first wristlet strand at its second end and being configured to lock said first and second blades in their closed position at its second end, and said second blade being configured to fasten to a second wristlet strand at its second end, wherein said first and second blades are hinged together by a pair of movable blades a first of their respective ends, and said moveable blades are connected to the first and second blades via a first hinge and a second hinge, and wherein said hinges are angularly delimited by stops respectively formed on the first end of the first and second blades and on a second end of the movable blades so as to define two predefined wearing positions depending on a size of a wrist.

2. The wristlet clasp according to claim 1, wherein the amplitude of an angular displacement of the hinges is comprised between 5° and 35°.

3. The wristlet clasp according to claim 2, wherein the movable blades have the same length.

4. The wristlet clasp according to claim 3, wherein the first ends of the first and second blades and the second ends of the moveable blades each have a notch, said ends being arranged to cooperate by interlocking at the notches.

5. The wristlet clasp according to claim 4, wherein free ends of the notches of the first and second blades have a semi-circular shape, and a bottom of the notch has a flat surface.

6. The wristlet clasp according to claim 4, wherein free ends of the notches of the movable blades have a rectilinear shape with a chamfer, and a bottom of the notch has a semi-circular surface.

7. The wristlet clasp according to claim 4, wherein the notches of the first and second blades are internal and the notches of the movable blades are external, or vice versa.

8. The wristlet clasp according to claim 1, wherein the blades are made of metal, metal alloy, composite material, or ceramic.

9. A wristwatch including a wristlet provided with the wristlet clasp according to claim 1.

* * * * *